United States Patent [19]

Vinci

[11] 3,961,660

[45] June 8, 1976

[54] DOOR OPERATING APPARATUS

[75] Inventor: J. Fredrick Vinci, Forest City, Iowa

[73] Assignee: Winnebago Industries, Inc., Forest City, Iowa

[22] Filed: Mar. 6, 1975

[21] Appl. No.: 556,166

[52] U.S. Cl. ..... 160/188; 49/345; 49/356

[51] Int. Cl.[2] ..... E05F 11/10

[58] Field of Search ..... 160/188, 213; 49/356, 49/357, 344, 345

[56] References Cited

UNITED STATES PATENTS

| | | | |
|---|---|---|---|
| 652,018 | 6/1900 | Duner | 160/188 |
| 2,198,572 | 4/1940 | Cross | 160/213 X |

*Primary Examiner*—Kenneth Downey
*Attorney, Agent, or Firm*—Burd, Braddock & Bartz

[57] ABSTRACT

A passenger carrying vehicle having a side door providing means to enter and exit the vehicle. A hand-operated door operating apparatus has a hand crank assembly that is manually movable by the operator of the vehicle to open and close the door. The door operating apparatus has a first linkage and a second linkage operatively connected to join the door to the hand crank assembly. The first linkage is movable to an over-center position to hold the door in a closed position. The second linkage is movable to an over-center position to hold the door in an open position. A common control link connects the first linkage to the second linkage.

16 Claims, 6 Drawing Figures

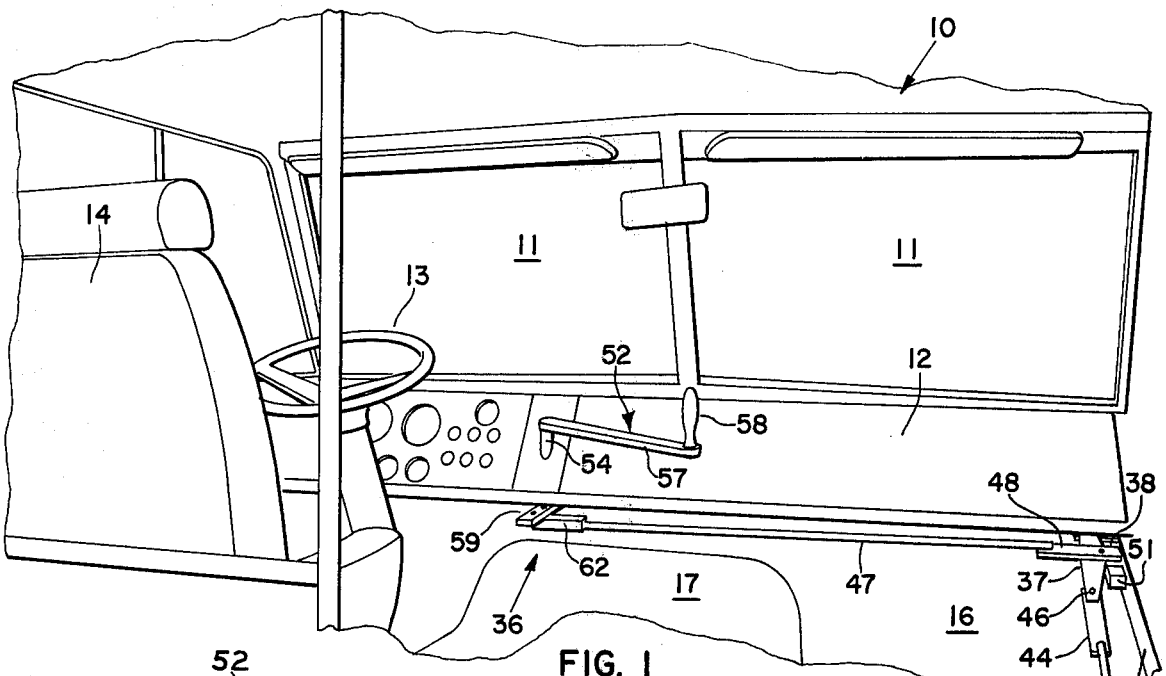
FIG. 1
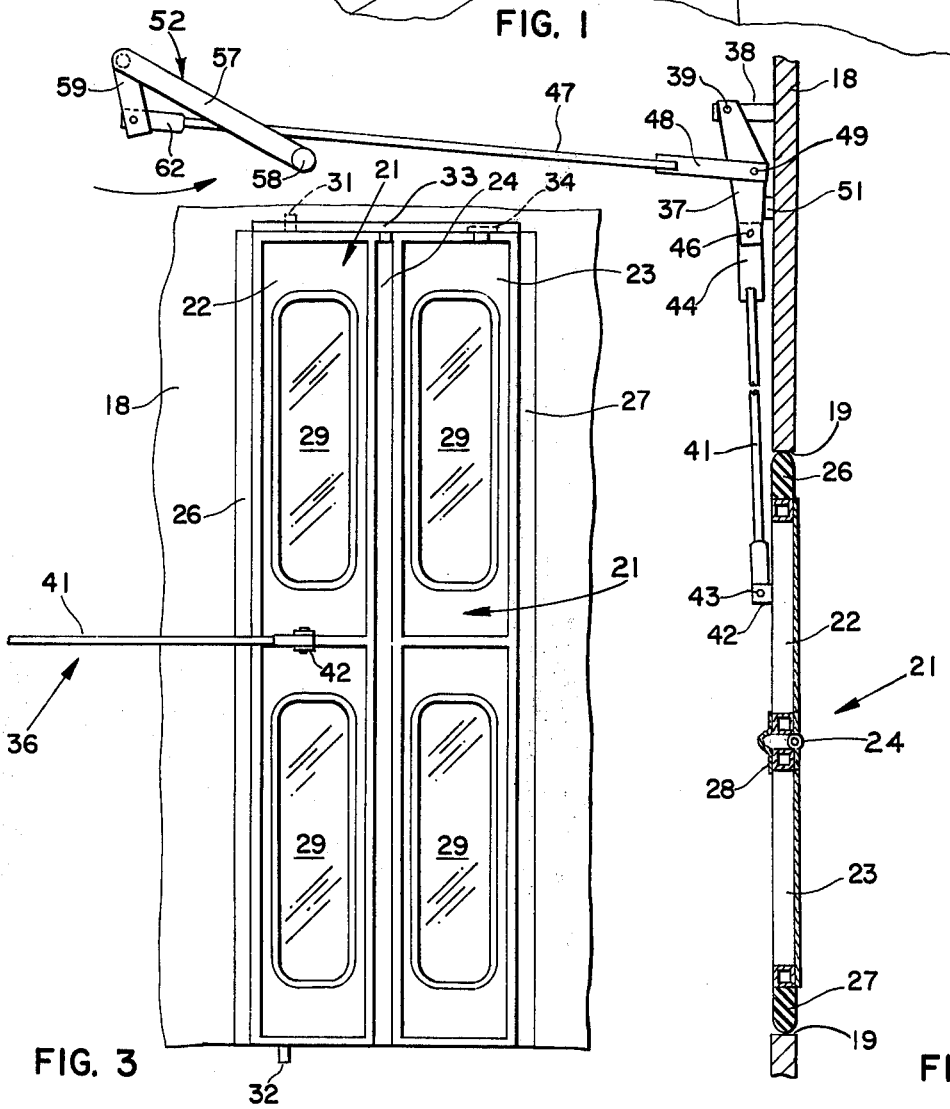
FIG. 3
FIG. 2

DOOR OPERATING APPARATUS

BACKGROUND OF INVENTION

Motor vehicles and railway cars are provided with side doors for the ingress and egress of passengers. These doors have mechanisms to open and close the doors. Air cylinders are conventionally used in conjunction with a link to pull the doors between the open and closed positions. An example of a power mechanism for opening a pair of doors is shown by Daugirdas in U.S. Pat. No. 3,844,062.

SUMMARY OF INVENTION

The invention relates in general to an apparatus for opening and closing doors and more particularly to a hand operated linkage structure for opening a folding side door on a vehicle, as a bus. The apparatus is operable to open and close a pair of folding doors pivotally mounted on the side wall of a passenger carrying vehicle. The apparatus has a control link connected to a first linkage and a second linkage. The first linkage connects the control link to the door and is operable to be moved to an over-center position to hold the door in a closed position. The second linkage connects the control link to a hand crank assembly that is manually movable by the operator of the vehicle. The hand crank assembly is operable to move to an over-center position to hold the door in an open position. Stop means cooperate with each linkage to fix the location of the over-center position of the linkages.

An object of the invention is to provide an improved apparatus for opening and closing doors that is safe and reliable in use and can be selectively locked in the door open and door closed positions. A further object of the invention is to provide a door opening apparatus that is manually operable and has a minimum of parts and utilizes a minimum of space. Yet another object of the invention is to provide a door opening apparatus that is economical to manufacture with a minimum amount of materials and has a strong and sturdy construction.

IN THE DRAWINGS

FIG. 1 is a perspective view of the inside front of a vehicle equipped with the door operating apparatus of the invention;

FIG. 2 is a top plan view of the door operating apparatus of FIG. 1 with the door in the closed position;

FIG. 3 is an inside elevational view of the door of the vehicle in FIG. 1 in the closed position;

Figure 4:
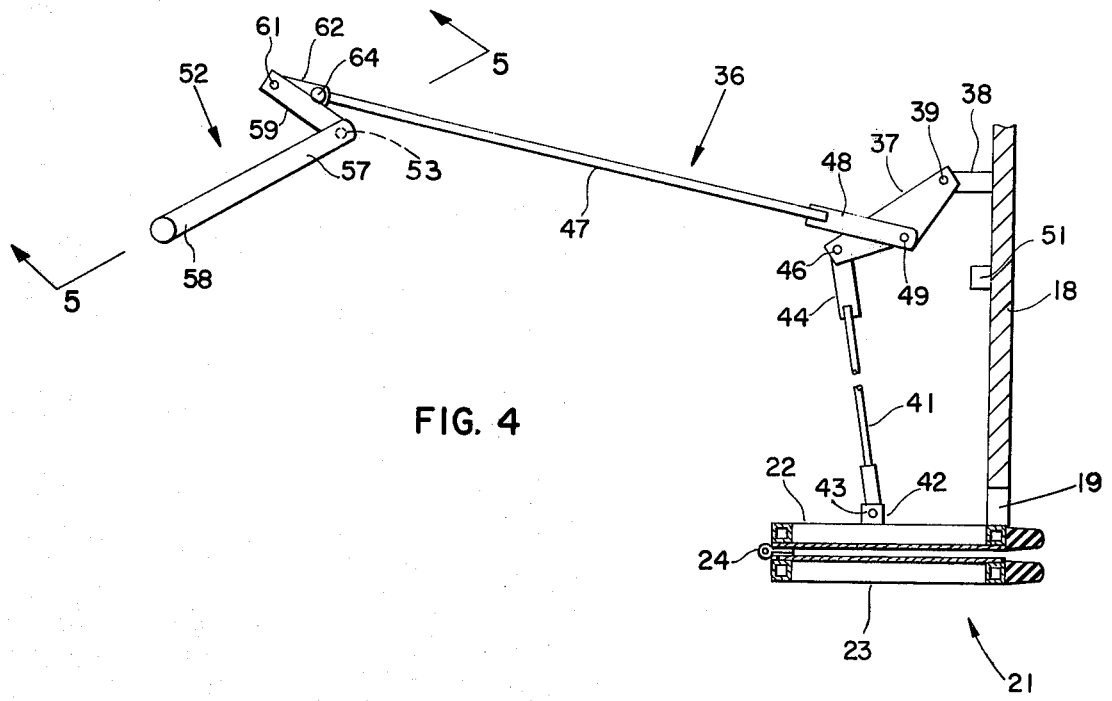
FIG. 4 is a top plan view similar to FIG. 2 of the door operating apparatus with the door in the open position.

DESCRIPTION OF PREFERRED EMBODIMENT:

Referring to FIG. 1 of the drawing, there is shown the inside of a vehicle shown generally at 10 looking in a forward direction. Vehicle 10 has a windshield 11 located above a dash panel 12. A conventional steering wheel 13 and driver's seat 14 are located on the left side of the vehicle. The seat 14 is mounted on floor 16 adjacent an engine cover 17. The cover 17 is releasably mounted on floor 16 with suitable fasteners (not shown). Referring to FIG. 2, vehicle 10 has a right side wall 18 having a doorway or opening 19 providing a passage for the ingress and egress of personnel into and out of the vehicle. The vehicle is preferably a bus, as shown in U.S. patent application Ser. No. 524,128, filed Nov. 15, 1974. The disclosure of this application is incorporated herein by reference. The vehicle has a side wall 18 with the doorway 19 in the front section of the right side of the vehicle. The doorway 19 is closed with a door indicated generally at 21 in FIGS. 2 and 3.

Door 21 has a pair of upright generally rectangular panels 22 and 23. The adjacent sides of the panels 22 and 23 are pivotally connected to each other with an upright hinge 24. Elongated vertical flexible members 26 and 27 are secured to the outside edges of panels 22 and 23, respectively, and function as flexible seals between the sides of the doorway 19 and the adjacent edges of panels 22 and 23. When the door 21 is in the closed position, the flexible members 26 and 27 engage the vertical sides of the doorway 19. An elongated vertical flexible cover 28 shown in FIG. 2 covers hinge 24 and is attached to the adjacent sides of panels 22 and 23. Each panel has a pair of vertical generally rectangular windows 29.

Door 21 is pivotally mounted on the upper and lower transverse portions of the doorway with hinge means or pivot pins 31 and 32, as shown in FIG. 3. Other types of pivotal connections can be used to pivotally connect panel 22 to the doorway structure.

A horizontal channel track 33 is secured to the top of the doorway and accommodates a roller 34. Roller 34 is mounted on an upright pin fixed to the top of the outer side of panel 23. The roller 34 rides in a channel in the track 33 to guide the outer side of the door 21 during opening and closing. The track 33 can be a generally inverted U-shaped rail member with the roller located in the channel of the rail. Other types of guide and follower structures can be used to control the movement of the door panels 22 and 23.

The door 21 is moved from the closed position to the open position with a door operating apparatus indicated generally at 36. Door operating apparatus 36 shown in FIGS. 2 and 4 comprises a linkage having two over-center positions to hold the door in the closed position and hold the door in the open position. Apparatus 36 has a control link 37 connected to a support 38 fixed to the side wall 18 with an upright pivot pin 39. A first rod 41 is pivotally mounted on a bracket 42 with an upright pin 43. Bracket 42 is secured to the midsection of the panel 22, as shown in FIG. 3. The forward end of rod 41 is connected to a generally flat bar 44. Bar 44 is pivotally connected to the rear end of control link 37 with an upright pivot pin 46. The position of the control link 37 is controlled with a second rod 47 secured to a horizontally flat bar 48. A pivot pin 49 connects the midsection of link 37 to the bar 48 so that movement of rod 47 will pivot the link 37 about the pivot pin 39. As shown in FIG. 2, when door 21 is in the closed position, link 37 is in engagement with a fixed stop 51 secured to side wall 18. The pivot pin 46 is located outwardly of a line passing through the pivot pins 39 and 43 whereby the biasing effect of the closed door 21 will hold the link 37 in engagement with the stop 51 as the pin 46 is in an over-center or outward position relative to the line passing through the pivot pins 39 and 43.

Figure 5:
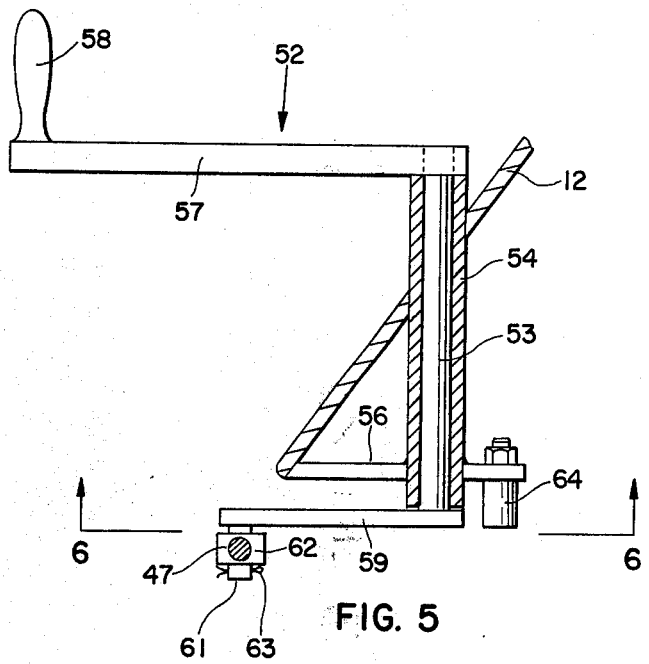
FIG. 5 is an enlarged sectional view taken along the line 5—5 of FIG. 4.

A hand crank assembly indicated generally at 52 is rotatably mounted on the dash 12 and connected to the end of rod 47. As shown in FIG. 5, hand crank assembly 52 has an upright shaft 53 rotatably mounted in an upright tube or sleeve 54. Sleeve 54 is secured to dash 12 and an inwardly directed horizontal support 56. The upper end of sleeve 54 extends a short distance upwardly from dash 12. Shaft 53 projects upwardly from the upper end of sleeve 54 and is secured to a generally horizontal handle 57. An upright hand grip 58 is mounted on the outer end of handle 57. The lower end of shaft 53 extends through the bottom of sleeve 54 and is attached to a horizontal arm 59. A downwardly directed pin 61 is secured to the outer end of arm 59. A block 62 having a suitable hole is rotatably mounted on pin 61. A key 63, as a cotter key, snap ring or the like, is used to hold the block 62 on pin 61.

Figure 6:
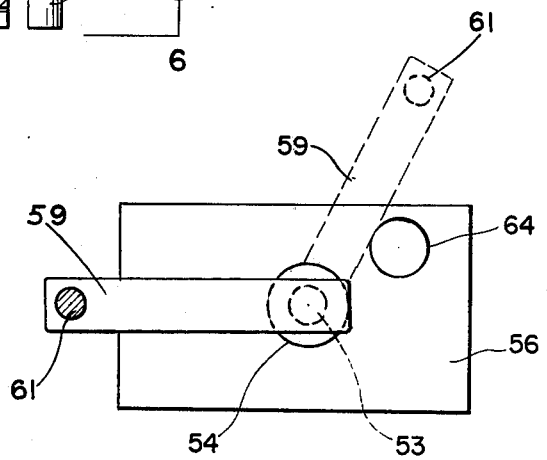
FIG. 6 is an enlarged sectional view taken along the line 6—6 of FIG. 5.

As shown in FIGS. 5 and 6, a downwardly directed stop member 64 is secured to the support 56. The arm 59 engages stop member 64 when the door is in the open position, thereby limiting the movement of arm 59. As shown in FIG. 4, when door 21 is in the open position, the line between the pivot pins 49 and 61 is forward of the axis of shaft 53. This places the arm 59 and rod 47 in an over-center position relative to the axis of shaft 53. The over-center relationship of this pivot axis holds the door 21 in its folded open position, as shown in FIG. 4. The biasing force of the folded door panels 22 and 23 exert a force on the link 37 which urges the link 37 toward the stop 51. The link 37 is held in a fixed position by rod 47 and the arm 59 in engagement with stop 64.

In use, with the door 21 in the closed position as shown in FIGS. 1–3, the handle 57 extends to the right and toward side wall 18. The control link 37 is in engagement with fixed stop 51. Pin 46, being in an over-center or outward position of a line passing through the pivot pins 39 and 43, locks the door 21 in the closed position. The over-center relationship between the pins 39, 43 and 46 holds the door in its closed position.

The door 21 is opened by moving the handle 57 in a clockwise or outward direction. This is accomplished by the operator of the vehicle by pulling on the hand grip 58. The handle 57 will rotate arm 59 clockwise. This exerts a pulling force on rod 47 and thereby pivots control link 37 away from the wall 18. As shown in FIG. 4, when control link 37 pivots in an outward direction, rod 41 pulls on door panel 22 to pivot the panel about the pivot pins 31 and 32. The door panel 23 pivots relative to the door panel 22 on the hinges 24. The outer end of panel 23 is controlled by the track 33 and its cooperating roller 34. The handle 57 is moved until arm 59 engages stop 64. When arm 59 is in its farthest position in engagement with the stop 54, the rod 47 is in an over-center position as the pivot pins 61 and 49 are not aligned with the axis of shaft 53. This over-center position of the rod 47 holds the door panels 22 and 23 in the folded open position, as shown in FIG. 4.

While there has been shown and described a preferred embodiment of the door operating apparatus of the invention, it is understood that modifications, changes, and substitutions of materials may be made by those skilled in the art without departing from the spirit of the invention.

The embodiments of the invention in which an exclusive property or privilege is claimed are defined as follows:

1. A vehicle comprising: a body having a passenger compartment and a wall having a doorway open to the passenger compartment, door means for selectively opening and closing the doorway, apparatus for opening and closing the door means, said apparatus having a control link with a first portion and a second portion, a support attached to the wall, first pivot means pivotally connecting the first portion to the support, rod means connecting the second portion to the door means whereby movement of the control link will open and close the door means, second pivot means connecting the rod means to the second portion, third pivot means pivotally connecting the rod means to the door means, first stop means engageable with the control link to locate the second pivot means in an outward over-center location relative to the first and second pivot means to thereby hold the door means in its closed position, and means connected to the control link for selectively moving the control link away from the stop means to open the door means and moving the control link toward the first stop means to close the door means, said means connected to the control link comprising a linkage, pivot means connecting the linkage to the control link, second stop means engageable with the linkage to hold the linkage in a fixed position locating the door means in the open position, said linkage including a first member pivotally connected to the control link and a second crank member, pivot means connecting the crank member to the first member, and means rotatably mounting the crank member on a part of the body, said crank member engageable with the second stop means to hold the pivot means in an over-center position relative to a line between the means mounting the crank member and the pivotal connection of the first member and control link thereby holding the door means in its open position.

2. The vehicle of claim 1 wherein: the body has a dash panel, said second crank member including a hand crank assembly movably mounted on the dash panel, said crank assembly having an arm engageable with the second stop means.

3. The vehicle of claim 1 wherein: the door means includes a first door panel and a second door panel and hinge means pivotally connecting adjacent sides of the panels together, and means pivotally mounting one of the door panels to the side wall.

4. The vehicle of claim 1 wherein: said control link has a third portion located between the first portion and the second portion, said pivot means connecting the linkage to the control link being connected to the third portion.

5. A vehicle comprising: a body having a passenger compartment and a wall having a doorway open to the passenger compartment, door means for selectively opening and closing the doorway, apparatus for opening and closing the door means, said apparatus having a control link with a first portion and a second portion, a support attached to the wall, first pivot means pivotally connecting the first portion to the support, rod means connecting the second portion to the door means whereby movement of the control link will open and close the door means, second pivot means connecting the rod means to the second portion, third pivot means pivotally connecting the rod means to the door means, first stop means engageable with the control link to locate the second pivot means in an outward over-center location relative to the first and second pivot means to thereby hold the door means in its closed position, and means connected to the control link for selectively moving the control link away from the stop means to open the door means and moving the control link toward the stop means to close the door means, said means connected to the control link comprising a linkage, pivot means connecting the linkage to the control link, second stop means engageable with the linkage to hold the linkage in a fixed position locating the door means in the open position, said linkage including a second rod means, fourth pivot means pivotally connecting the second rod means to the link, a hand crank assembly connected to the rod means for moving the rod means and thereby moving the control link, said crank assenbly comprising an upright shaft, arm means fixed to said shaft, fifth pivot means pivotally connecting the second rod means to the arm means, a handle connected to the shaft for rotating said shaft and arm means and a fixed stop engageable with the arm means to locate the fourth and fifth pivot means in an off-center relation with respect to the axis of the shaft means when the arm means is engageable with the stop to thereby hold the door means in the open position.

6. The vehicle of claim 5 including: a dash panel, sleeve means mounted on the dash panel rotatably carrying the shaft means, said fixed support being mounted on said dash panel.

7. A vehicle comprising: a body having a passenger compartment and a wall, said wall having a doorway, door means for selectively opening and closing the doorway, apparatus for opening and closing the door means, said apparatus having a control link, a support attached to the wall, first pivot means pivotally connecting the control link to the support, first means connecting the control link to the door means whereby movement of the control link will open and close the door means, second pivot means connecting the first means to the link, third pivot means pivotally connecting the first means to the door means, first stop means engageable with the link to locate the second pivot means in an outward over-center location relative to the first and third pivot means to thereby hold the door means in its closed position, second means connected to the control link for moving the control link, second stop means engageable with the second means to limit movement of the second means, said second means connected to the control link including linkage means having a first member pivotally connected to the control link and a second member, means mounting the second member on the body, fourth pivot means connecting the second member to the first member, said second member engageable with the second stop means to hold the fourth pivot means in an over-center position relative to a line between the means mounting the second member and the pivotal connection of the first member and the control link thereby holding the door means in its open position.

8. The vehicle of claim 7 including: a dash panel, said second member including a hand crank assembly having an upright sleeve mounted on the dash panel, said shaft being rotatably positioned in said sleeve, said second stop means being attached to a portion of said panel.

9. The vehicle of claim 8 wherein: the hand crank assembly includes a handle having a hand grip attached to the shaft and an arm attached to the shaft, said first pivot means being connected to the arm to attach the rod means to said arm.

10. The vehicle of claim 7 wherein: the door means includes a first door panel and a second door panel and hinge means pivotally connecting adjacent sides of the panels together, and means pivotally mounting one of the door panels to the side wall.

11. An apparatus for opening and closing a door pivotally mounted on a support comprising: a control link having a first portion and a second portion, rod means connecting the second portion to the door whereby movement of the control link will open and close the door, a first pivot pivotally connecting the first section to a fixed support, a second pivot pivotally connecting the second portion to the rod means, a third pivot pivotally connecting the second portion to the rod means, a third pivot pivotally connecting the rod means to the door, first stop means engageable with the control link to locate the second pivot in an outward over-center position relative to the first and third pivots to thereby hold the door in its closed position when the control link engages the first stop means, and means connected to the control link for moving the control link away from the first stop means to open the door and toward the first stop means to close the door, said means connected to the control link comprising a linkage, first pivot means connecting the linkage to the control link, second stop means engageable with the linkage to hold the linkage in a fixed position locating the door means in the open position, said linkage including a first member pivotally connected to the control link and a second crank member, second pivot means connecting the crank member to the first member, and means rotatably mounting the crank member on a support, said crank member engageable with the second stop means to hold the second pivot means in an over-center position relative to a line between the means mounting the crank member and the first pivot means and control link thereby holding the door means in its open position.

12. The apparatus of claim 11 wherein: the door means includes a first door panel and a second door panel and hinge means pivotally connecting adjacent sides of the panels together, and means pivotally mounting one of the door panels to the side wall.

13. The apparatus of claim 11 wherein: said control link has a third portion located between the first portion and the second portion, said pivot means connecting the linkage to the control link being connected to the third portion.

14. An apparatus for opening and closing a door pivotally mounted on a support comprising: a control link having a first portion and a second portion, rod means connecting the second portion to the door whereby movement of the control link will open and close the door, a first pivot means pivotally connecting the first section to a fixed support, a second pivot means pivotally connecting the second portion to the rod means, a third pivot means pivotally connecting the rod means to the door, first stop means engageable with the control link to locate the second pivot means in an outward over-center position relative to the first and third pivot means to thereby hold the door in its closed position when the control link engages the stop means, and means connected to the control link for moving the control link away from the stop means to open the door and toward the stop means to close the door, said means connected to the control link comprising a linkage, fourth pivot means connecting the linkage to the control link, second stop means engageable with the linkage to hold the linkage in a fixed position locating the door means in the open position, said linkage including a second rod means, said fourth pivot means pivotally connecting the second rod means to the link, a hand crank assembly connected to the rod means for moving the rod means and thereby moving the control link, said crank assembly comprising an upright shaft, arm means fixed to said shaft, fifth pivot means pivotally connecting the second rod means to the arm means, a handle connected to the shaft for rotating said shaft and arm means, said second stop means engageable with the arm means to locate the fifth pivot means in an off-center relation with respect to the axis of the shaft means and the fourth pivot means when the arm means is engageable with the second stop means to thereby hold the door means in the open position.

15. An apparatus for moving a door movably mounted on a support to an open position and a closed position comprising: first linkage means having a control link, first pivot means mounting the control link on the support, means connecting the control link to the door whereby movement of the control link will move the door between the open and closed positions thereof, first fixed stop means engaged by the first linkage means when the door is in the closed position whereby the first linkage means holds the door in its closed position, second linkage means connected to the control link and operable to move the control link to open and close the door, means movably mounting the second linkage means on the support, and second fixed stop means engaged by the second linkage means when the door is in the open position whereby the second linkage means holds the door in its open position, said linkage means having a member connected to the control link and operable to move the control link to open and close the door, a crank member, pivot means connecting the member to the crank member, means rotatably mounting the crank member on the support, and an arm on the crank member, said arm engageable with the second fixed stop means when the door is in the open position.

16. The apparatus of claim 15 wherein: the means connecting the control link to the door includes a rod, means pivotally mounting the rod to the control link, and means pivotally mounting the rod to the door, the pivot means between the rod and the control link being located off-center when the linkage means engages the stop means thereby holding the door in the closed position.

* * * * *